United States Patent [19]

Sasaki et al.

[11] Patent Number: 4,519,980

[45] Date of Patent: May 28, 1985

[54] FIN MATERIALS FOR AUTOMOBILE RADIATORS

[75] Inventors: Hajime Sasaki; Shinichi Nishiyama, both of Tsuchiura, Japan

[73] Assignee: Hitachi Cable, Ltd., Tokyo, Japan

[21] Appl. No.: 499,243

[22] Filed: May 31, 1983

[51] Int. Cl.[3] ..... C22C 9/02

[52] U.S. Cl. ..... 420/474; 420/491; 420/498

[58] Field of Search ..... 420/469, 470, 474, 475, 420/476, 477, 481, 482, 483, 485, 487, 491, 493, 420/494, 497, 498, 499

[56] References Cited

U.S. PATENT DOCUMENTS 3,649,254 3/1972 Servi ..... 420/470

FOREIGN PATENT DOCUMENTS

| | | | |
|---|---|---|---|
| 819426 | 4/1973 | Japan | 420/485 |
| 4179 | 2/1975 | Japan | 420/470 |
| 13136 | 1/1982 | Japan | 420/469 |
| 140878 | 8/1982 | Japan | 420/469 |
| 207138 | 12/1982 | Japan | 420/491 |
| 207137 | 12/1982 | Japan | 420/481 |
| 198235 | 12/1982 | Japan | 420/481 |
| 1027366 | 4/1966 | United Kingdom | 420/498 |

*Primary Examiner*—L. Dewayne Rutledge
*Assistant Examiner*—Christopher W. Brody
*Attorney, Agent, or Firm*—Antonelli, Terry & Wands

[57] ABSTRACT

A fin material for automobile radiators comprising less than 0.05% by weight of lead; from 0.001 to 0.05% by weight of one or more elements selected from a group consisting of silver, cadmium, chromium, magnesium, nickel, antimony, tin, zinc and rare-earth element; and the remaining copper.

4 Claims, 2 Drawing Figures

FIN MATERIALS FOR AUTOMOBILE RADIATORS

BACKGROUND OF THE INVENTION

The present invention relates to a fin material used for an automobile radiator.

The automobile radiator is used to prevent an excess rise in the temperature of the automobile engine section and cools the engine section by circulating the cooling medium such as water between the engine section and the radiator and radiating heat of water rised in temperature in the engine section. The radiator consists of a tube to pass water through and a fin to emit heat from the tube and is usually mounted on the front of the automobile. The airflow required to remove the heat from the radiator is supplied by an engine-drive fan to promote radiation of the heat.

As such a fin material for the radiator, a thin sheet made of a Cu-Sn alloy or Cu-Cd alloy has been utilized heretofore. This alloy is the material of which heat-resistance has been improved by adding a suitable amount of tin or cadmium into copper in the range unimpairing the excellent thermal conductivity and workability of copper so as to prevent the softening of the fin in a process for soldering the fin to a tube upon assembling the radiator. However, with the worsening of automobile travelling environment in recent years, it has become apparent that the conventional copper alloys are significantly inferior in corrosion resistance. In this corrosion the oxidized films of cuprous oxide are formed in layers on the surface on the fin and scale off to fall to pieces. According to circumstances it is feared that the corrosion proceeds in about two years after commencement of use and brings about falling off the fin from the tube.

For such a problem, the present inventors et al. have proposed a copper-lead alloy consisting of a small amount of lead as a material for the radiator fin excellent in corrosion resistance (refer to Japanese Patent Laid Open No. 207138/83). However, this Cu-Pb alloy has a disadvantage that with an increase in an additional amount of lead the embrittlement of the alloy is observed upon hot-working thereof thereby rendering it difficult.

Therefore, considering the workability of such alloy, the heat resistance of this alloy will be impaired.

SUMMARY OF THE INVENTION

It is therefore an object of the present invention to provide a fin material for an automobile radiator having improved heat resistance, corrosion resistance and other excellent physical properties.

According to the present invention, such an object of this invention can be achieved by employing a copper alloy comprising less than 0.5% by weight of lead; from 0.001 to 0.08% by weight of one or more elements selected from a group consisting of silver, cadmium, chromium, magnesium, manganese, nickel, antimony, tin, zinc and rare-earth element; and copper of the remainder.

DETAILED DESCRIPTION OF THE PREFERRED EMBODIMENTS OF THE INVENTION

Figure 1:
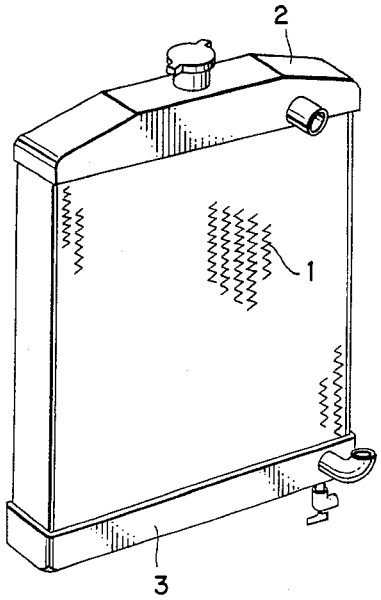
FIG. 1 is a perspective view of an automobile radiator having fins fashioned of a material in accordance with the present invention.
Figure 2:
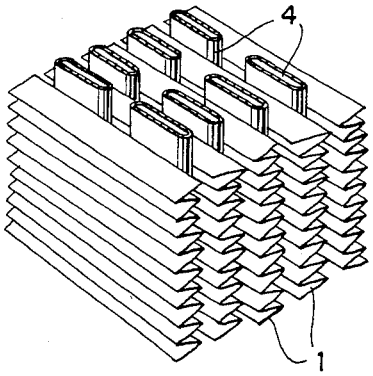
FIG. 2 is an enlarged detail view of a fin structure of the radiator of FIG. 1.

Referring now to the drawings wherein like reference numerals are used in both views to designate like parts, and more particularly, to FIG. 1, according to this figure, a radiator for a motor vehicle (not shown) includes an upper header 2 and a lower header 3 between which is arranged a fin structure 1 formed of a plurality of thin sheet members corrugated or undulated in the manner illustrated most clearly in FIG. 2. A plurality of coolant conducting conduits or pipes 4 are disposed in the fin structure 1 and communicate with the upper and lower headers 2, 3 in a conventional manner.

It is obvious from the above description that the copper alloy of the fin material of the present invention for the fin structure 1 of an automobile radiator contains a very small amount of alloying element or elements. This is on the ground of that further increase in addition of alloying elements tends to hinder the adhesion of copper oxidized film to its substrate. Thus, it is preferred to use a high purity, oxygen free copper material having less than 50 ppm of oxygen. A phosphorus deoxidized copper material may also be used. However, the presence of phosphorus in copper is liable to peel off the oxidized films of copper, so that it is advantageous for the present invention to use a substantially oxygen-free copper such as copper produced in a reductive atmosphere, copper produced in an inert atmosphere through a charcoal coating, and the like without treating copper with such a phosphorus deoxidizer.

The copper alloy according to the present invention contains lead and at least one other elements and each of these elements has an important role in the control of properties and/or characteristics of the copper alloy.

Lead is little dissolved in copper and does hardly impair the adhesion of oxidized film formed to the substrate, and thus the corrosion resistance of the alloy may be remarkably improved by addition of lead. Furthermore in addition of a small amount of lead, lead contributes to improvement in heat resistance of the copper alloy. In such a case, the presence of more than at least 0.001% by weight of lead is advantageous for the copper alloy. In spite of such characteristics, addition of lead into the alloy embrittles it upon hot-working thereof and impairs workability of the alloy, so that the lead content should not exceed 0.05% by weight.

On the other hand, each of silver, cadmium, chromium, magnesium, manganese, nickel, antimony, tin, zinc and rare-earth element added into copper mainly improves heat resistance of the resulting copper alloy and thus from 0.001 to 0.08% by weight, for example, 0.003 to 0.05% by weight in total of one or more elements selected from them should be contained in the alloy. If such elements exist in a total amount of less than 0.001% by weight, the improvement in heat resistance of the alloy will be slight, and the presence of more than 0.05% by weight of them will impair the corrosion resistance of the alloy. However, when further high heat resistance of the alloy is required, it is conveniently to increase an amount of the elements other than lead described above, in particular, tin or cadmium. This is because the addition of less than 0.08% by weight of tin or cadmium can improve heat resistance of the alloy without appreciably impairing corrosion resistance of the alloy. In this case, it is preferable to lower a total content of the alloying elements, so that the content of lead in the alloy is required to be less than 0.005% by weight, and the desirable content of tin or cadmium is more than 0.01% by weight for retaining the heat resistance of the alloy.

The advantages and attributes of the present invention may be more clearly understood by reference to the following examples which intended to illustrate, but not to limit, the scope of the present invention.

EXAMPLES

Each ingot having composition shown in Table 1 was made by melting an oxygen free copper material of 99.99% purity with a high frequency melting furnace, adding a respective alloying element into the resulting melted copper by a conventional technique to provide the desired composition, and casting the resulting alloyed melt into a metal mould to produce an ingot having a 80 mm diameter. In this process, each rare-earth element was added into the copper melt in the form of misch metal.

Each ingot thus obtained was then hot-worked to a plate having a thickness of 10 mm, then cold rolling and annealing of the plate were twice repeated to form a sheet having 0.1 mm in thickness, and finally the sheet was subject to a 50% cold reduction to obtain a thin sheet having 0.05 mm in thickness.

From this thin sheet were withdrawn the specimens or samples for a corrosion resistant test, a heat resistant test and for evaluation of thermal conductivity. The performances of each specimen were measured and the results shown in Table 2 were obtained.

Considering the temperature of soldering fins to a radiator tube, the heat resistant test was effected by measuring the hardness of each specimen after heating it at 350° C. for 10 minutes.

The corrosion test was made as follows: each specimen was placed under a steam atmosphre kept at 80° C. in a box of constant temperature and humidity, subject to an adequate amount of salt solution spray comprising 2% NaCl and 2% $Na_2SO_4$ once every two hours under the conventional indoor atomsphere. After repeating this procedure every day for 100 days, the specimen was buried into the mass of synthetic resin and its cross section was polished to measure an average residual thickness of the specimen. From the measured value and the initial thickness of the specimen was calculated a residual rate of the thickness. Examination of each specimen after the corrosion test showed that the form of the corrosion was the corrosion that proceeds while forming the coatings of cuprous oxide similarly to the actual corrosion of radiator fins.

With regard to thermal conductivity of each sample, the electric conductivity having high regular correlation therewith was measured.

From the results shown in Table 2, it is understandable that the alloys of the present invention, i.e., sample Nos. 1 to 17 have a high residual percent in thickness and a good corrosion resistance, compared with the conventional copper alloy, i.e., sample No. 18. Converting these values to the amounts of corrosion in thickness, the alloys of the present invention have the values of from one-second to one-third of that of sample No. 18. Any of the alloys according to the present invention has the hardness at least as high as 95 hence its heat resistance is superior to that of sample No. 19 and also it has the electric conductivity higher than 90 except sample No. 13. From this result, the characteristics of high radiation can be expected for the present invention.

As described above, the copper alloys according to the present invention have the sufficient heat resistance to use them as a fin material as well as the improved corrosion resistance and hence have a remarkable effect which can improve the life of the fins used for automobile radiators.

TABLE 1

| Sample No. | Compositions of Alloys (wt %) Pb | Other Elements | Remainder |
|---|---|---|---|
| Present Alloys | | | |
| 1 | 0.01 | 0.01 Ag | Cu |
| 2 | 0.01 | 0.01 Sn | Cu |
| 3 | 0.01 | 0.01 Sb | Cu |
| 4 | 0.01 | 0.01 Cr | Cu |
| 5 | 0.01 | 0.01 Mn | Cu |
| 6 | 0.01 | 0.01 Mg | Cu |
| 7 | 0.01 | 0.01 misch metal | Cu |
| 8 | 0.01 | 0.01 misch metal and 0.01 Ag | Cu |
| 9 | 0.001 | 0.07 Sn | Cu |
| 10 | 0.04 | 0.03 Sn | Cu |
| 11 | 0.003 | 0.04 Sn | Cu |
| 12 | 0.003 | 0.04 Ag | Cu |
| 13 | 0.003 | 0.04 Sb | Cu |
| 14 | 0.01 | 0.03 Cd | Cu |
| 15 | 0.01 | 0.04 Ni | Cu |
| 16 | 0.01 | 0.04 Zn | Cu |
| 17 | 0.01 | 0.03 Zn and 0.03 Sn | Cu |
| Reference Alloys | | | |
| 18 | — | 0.12 Sn | Cu |
| 19 | 0.01 | — | Cu |
| 20 | 0.002 | 0.1 Sn | Cu |

TABLE 2

| Sample No. | Electric conductivity (% IACS) | Hardness after heating at 350° C., 10 min. | Average residual rate of thick. (%) |
|---|---|---|---|
| Present Alloys | | | |
| 1 | 98.3 | 107 | 79 |
| 2 | 97.0 | 105 | 70 |
| 3 | 90.5 | 107 | 71 |
| 4 | 95.7 | 113 | 77 |
| 5 | 90.3 | 110 | 71 |
| 6 | 91.0 | 115 | 77 |
| 7 | 92.5 | 109 | 80 |
| 8 | 97.4 | 117 | 71 |
| 9 | 94.2 | 125 | 67 |
| 10 | 93.5 | 120 | 69 |
| 11 | 95.2 | 118 | 67 |
| 12 | 96.5 | 117 | 72 |
| 13 | 89.0 | 111 | 67 |
| 14 | 95.1 | 119 | 68 |
| 15 | 92.6 | 96 | 70 |
| 16 | 95.3 | 95 | 69 |
| 17 | 94.9 | 118 | 69 |
| Reference Alloys | | | |
| 18 | 92.0 | 115 | 31 |
| 19 | 98.7 | 70 | 82 |
| 20 | 92.0 | 125 | 33 |

What is claimed is:

1. A fin material for automobile radiators consisting essentially of from 0.001 to 0.005% by weight of lead; from 0.03 to 0.08% by weight tin or cadmium; and the remainder of copper.

2. A fin material for automobile radiators consisting essentially of from 0.001 to 0.005% by weight of lead;

from 0.01 to 0.08% by weight of tin or cadmium; and the remainder of copper.

3. The fin material for automobile radiators according to claim 1, wherein said remainder of copper is a high purity, oxygen free copper having an oxygen content of less than 50 ppm.

4. The fin material for automobile radiators according to claim 2, wherein said remainder of copper is a high purity, oxygen free copper having an oxygen content of less than 50 ppm.

* * * * *